United States Patent [19]

Scott

[11] Patent Number: 4,764,663

[45] Date of Patent: Aug. 16, 1988

[54] ELECTRIC RADIATION HEATER ASSEMBLIES

[75] Inventor: Richard C. Scott, Stourport-on-Severn, United Kingdom

[73] Assignee: Micropore International Limited, Droitwich, United Kingdom

[21] Appl. No.: 7,397

[22] Filed: Jan. 27, 1987

[30] Foreign Application Priority Data

Feb. 1, 1986 [GB] United Kingdom ..... 8602507

[51] Int. Cl.[4] ..... H05B 3/68

[52] U.S. Cl. ..... 219/448; 219/452; 219/505; 219/481; 219/492

[58] Field of Search ..... 219/448, 449, 450, 451, 219/452, 453, 464, 465, 466, 492, 493, 504, 505, 485, 481; 323/283, 321, 908; 361/118, 51, 31

[56] References Cited

U.S. PATENT DOCUMENTS

| | | | |
|---|---|---|---|
| 3,017,564 | 1/1962 | Barney | 323/908 |
| 3,112,435 | 11/1963 | Barney | 323/908 |
| 4,236,198 | 11/1980 | Ohsawa | 323/908 |
| 4,555,741 | 11/1985 | Masaki | 323/908 |
| 4,628,431 | 12/1986 | Kayser | 323/908 |

FOREIGN PATENT DOCUMENTS

| | | | |
|---|---|---|---|
| 0164900 | 12/1985 | European Pat. Off. | 219/459 |
| 2306466 | 12/1970 | France . | |
| 2083327 | 3/1982 | United Kingdom . | |
| 2114292 | 8/1983 | United Kingdom . | |
| 2155289 | 9/1985 | United Kingdom | 219/448 |

OTHER PUBLICATIONS

Driscoll, C. D., "Surge Current Limiter . . . ", IBM Tech. Disc. Bull., vol. 24, No. 3, Aug. 1981, pp. 1439–1440.

*Primary Examiner*—E. A. Goldberg
*Assistant Examiner*—Teresa J. Walberg
*Attorney, Agent, or Firm*—Browdy and Neimark

[57] ABSTRACT

An electric radiation heater assembly for a glass ceramic top cooker includes at least one heating element having a substantial positive temperature coefficient of resistance, such as an infra-red lamp. A resistive assembly is electrically connected in series with the at least one heating element for suppressing surges of electric current due to the low initial resistance of the heating element. Switch means is operable a time interval of at least thirty milliseconds and preferably about ½ second after a supply of electric power to the heater is energized so as to reduce the combined electrical resistance of the heating element and the resistive assembly.

21 Claims, 4 Drawing Sheets

FIG. 3.
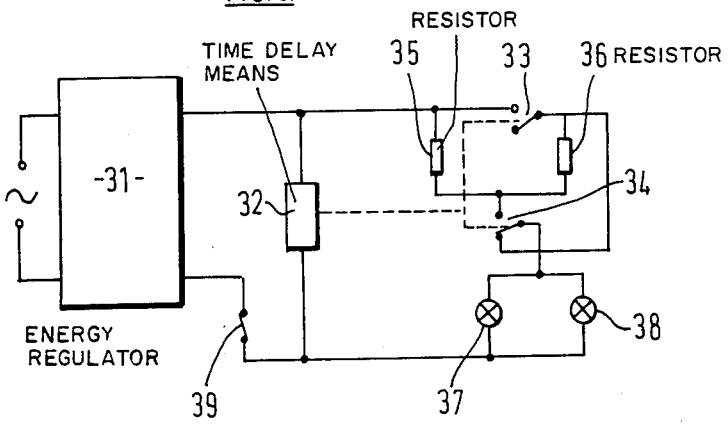
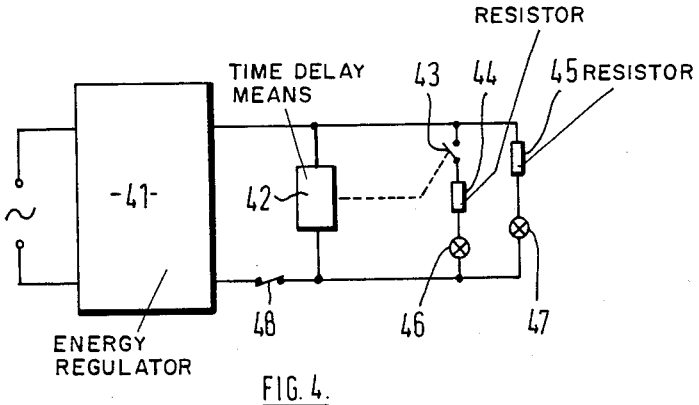
FIG. 4.

ELECTRIC RADIATION HEATER ASSEMBLIES

FIELD OF THE INVENTION

The present invention relates to electric radiation heater assemblies for glass ceramic top cookers.

DESCRIPTION OF PRIOR ART

It is known that the use of heating elements with high operating temperatures, such as infra-red lamps, in glass ceramic top cookers gives rise to an improvement in cooking performance as a result of improved radiant heat transfer, fast response to changes in control settings and visual feedback of the control setting. However, because of the large positive temperature coefficient of resistance associated with infra-red lamps, the initial or inrush current is very high and this can cause problems such as tripping of magnetic circuit breakers and mains disturbances.

In order to reduce these problems it is known to connect a bare wire resistance coil, known as a ballast coil, in series with the infra-red lamp or lamps. If the power consumed by such a ballast coil is significant, i.e. more than a few per cent of the total power consumed by the heater, it is considered essential to position the ballast coil within the body of the heater. In practice, the power consumed by the ballast coil is typically one third of the total power. This eliminates the problems with magnetic circuit breakers and reduces mains disturbances to an acceptable level with relatively low power heaters i.e. up to about 1500 watts. However, higher power heaters can still result in unacceptable disturbances to the mains electricity unless the resistance of the ballast coil is increased, but increasing the resistance of the ballast coil reduces the advantages of using infra-red lamps because it reduces the proportion of the power of the heater generated by the lamps.

OBJECT OF THE INVENTION

It is an object of the present invention to provide a radiation heater assembly for a glass ceramic top cooker which incorporates a heating element having a substantial positive temperature coefficient of resistance and a ballast coil and which does not result in unacceptable disturbances to the mains electricity.

SUMMARY OF THE INVENTION

According to the present invention there is provided an electric radiation heater assembly comprising:

at least one heating element having a substantial positive temperature coefficient of resistance;

a resistive assembly electrically connected in series with said at least one heating element for suppressing surge of electric current due to said at least one heating element; and switch means operable a time interval of at least thirty milliseconds after a supply of electric power to the heater is energised so as to reduce the combined electrical resistance of said at least one heating element and of said resistive assembly.

The heater assembly may comprise two heating elements and the or each heating element may comprise an infra-red lamp.

The resistive assembly may comprise a single resistive element which may be positioned within or externally of the body of the heater, the resistive element being electrically short-circuited after said time interval. Alternatively, the resistive assembly may comprise two resistive elements electrically connected in parallel, one of said resistive elements being electrically open-circuit until said time interval has expired.

The switch means may comprise a relay including an actuating coil which is connected across said at least one heating element. Alternatively, the switch means may comprise a PTC thermistor in combination with a bi-metallic snap switch.

The time interval may be from 30 milliseconds to 10 seconds, but is preferably about ½ second. For a better understanding of the present invention and to show more clearly how it may be carried into effect reference will now be made, by way of example, to the accompanying drawings in which:

BRIEF DESCRIPTION OF THE DRAWINGS

FIG. 3 is a diagrammatic illustration of a second embodiment of a circuit diagram for a radiation heater according to the present invention;

FIG. 4 is a diagrammatic illustration of a third embodiment of a circuit diagram for a radiation heater according to the present invention;

DESCRIPTION OF PREFERRED EMBODIMENTS

Figure 1:
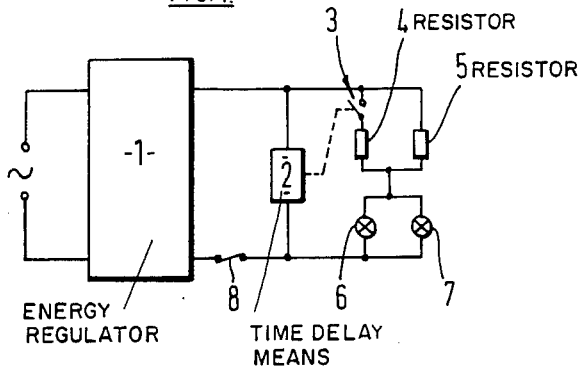
FIG. 1 is a diagrammatic illustration of one embodiment of a circuit diagram for a radiation heater according to the present invention.

The circuit depicted by means of the circuit diagram shown in FIG. 1 comprises an energy regulator 1, a time delay means 2 which is connected to the output side of the energy regulator 1 and which operates a switch 3 a predetermined time after each occasion the energy regulator permits electric current to pass therethrough, a pair of resistors 4,5 each in the form of a coil of bare resistance wire, a pair of infra-red lamps 6,7 which are electrically connected in parallel, and a thermal cut-out device 8.

In operation, the energy regulator 1 is moved from an "off" position to an infinitely variable "on" position in which for higher settings the energy regulator permits electric current to pass therethrough for a greater proportion of a given period. Once the energy regulator is moved to an "on" position electric current passes through the energy regulator to the time delay means, to the switch 3 and to one of the resistors 5. Current flows through the resistor 5 through the lamps 6,7 which are connected in parallel and back to the energy regulator 1. After a predetermined time, the time delay means 2 operates to close the switch 3 and thus allows current to pass through resistor 4. Because resistors 4,5 are now connected in parallel this effectively halves their combined resistance and causes the electric current flowing through the lamps 6,7 to increase.

We have found that the time delay may vary considerably. However, if the time delay is very short, i.e. less than 30 milliseconds, the lamps will effectively be energised simultaneously thus not reducing any mains disturbance that might arise, whilst if the time delay is much more than 10 seconds one of the resistors 4 will be energised for a significantly shorter period than the other resistor at low settings of the energy regulator. In practice, we have found that a time delay of about ½ second is to be preferred.

Figure 2:
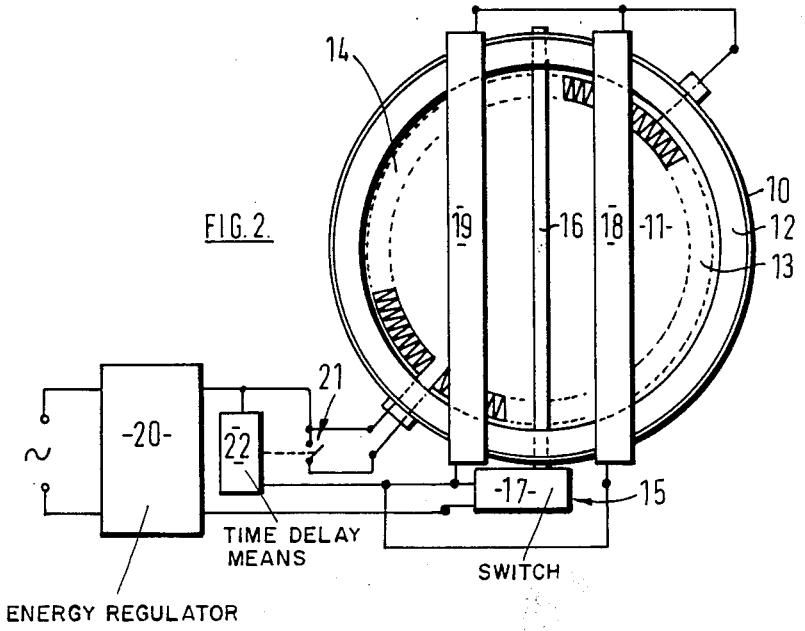
FIG. 2 shows a radiation heater according to the present invention and incorporating the circuit depicted in the circuit diagram of FIG. 1.

The radiant heater shown in FIG. 2 embodies the circuit diagram of FIG. 1 and comprises a dish 10, for example pressed from sheet metal, which contains a base layer 11 of thermal and electrical insulating material and a peripheral wall 12 of thermal insulating material. A helical coil of bare resistance wire is arranged on the base layer and extends substantially in a circle adjacent to the peripheral wall 12. The coil is centre-tapped to form two resistance elements 13,14.

A thermal cut-out device 15 extends across substantially the centre of the dish 10 and comprises a temperature sensor 16 connected to a switch 17. In the event that the temperature sensor 16 detects an excessive temperature the switch 17 is actuated to de-energise the heating elements until such time as the temperature has dropped to an acceptable level. Two infra-red lamps 18,19 extend across the dish 10, one lamp being positioned on each side of the temperature sensor 16.

A.C. power is supplied to the resistance elements 13,14 and to the infra-red lamps 18,19 by way of an energy regulator 20 and, in the case of resistance element 13, a switch 21. Switch 21 is connected to a time delay mechanism 22.

For a heater rated at 1800 watts at 220 volts, the lamps 18,19 are typically rated at 600 watts at 147 volts each, with the resistance elements 13,14 rated at 17.9 ohms each with the resistance wire at its operating temperature. This arrangement results in approximately 67 percent of the energy being derived from the infra-red lamps 18,19.

The circuit depicted by means of the circuit diagram shown in FIG. 3 comprises an energy regulator 31 and a time delay means 32 which is connected to the output side of the energy regulator 31 and which operates witches 33,34 a predetermined time after each occasion the energy regulator permits electric current to pass therethrough. A resistive assembly comprises a pair of resistors 35,36 each in the form of a coil of bare resistance wire which are connected with the switches 33,34 so as to be electrically connected in series and in parallel as will be explained in more detail hereinafter. A pair of infra-red lamps 37,38 are electrically connected in parallel with each other and in series with the resistive assembly. A thermal cut-out device 39 is electrically connected in series with the lamps 37,38 for preventing excessive temperatures.

Operation of the circuit depicted in FIG. 3 is similar to the operation of the circuit depicted in FIG. 1 except that initially the two resistors 35,36 are connected in series and the delay means 32 operates switches 33,34 to connect the resistors 35,36 in parallel. This arrangement has the advantage of increasing the initial resistance compared with the circuit depicted in FIG. 1, but a double-pole change-over switch is required and the switches are required to break a current and will therefore need to be heavier duty.

The circuit depicted in FIG. 4 comprises an energy regulator 41 and a time delay means 42 which is connected to the output of the energy regulator and which operates switch 43 a predetermined time after each occasion the energy regulator permits current to pass. When the energy regulator is conductive electric current passes through resistor 45, infra-red lamp 47, and thermal cut-out device 48 and after a predetermined delay switch 43 is closed and causes resistor 44 and lamp 46 to be connected in parallel with resistor 45 and infra-red lamp 47. Thus the lamps 46,47 are energised separately which further suppresses the inrush current, but two separate resistors are required rather than a single centre-tapped resistor.

Figure 5:
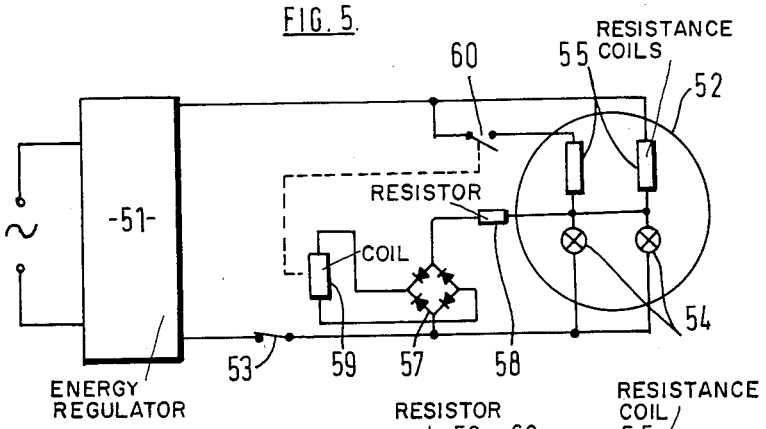
FIGS. 5,6 and 7 are circuit diagrams of further embodiments of the present invention.
Figure 6:
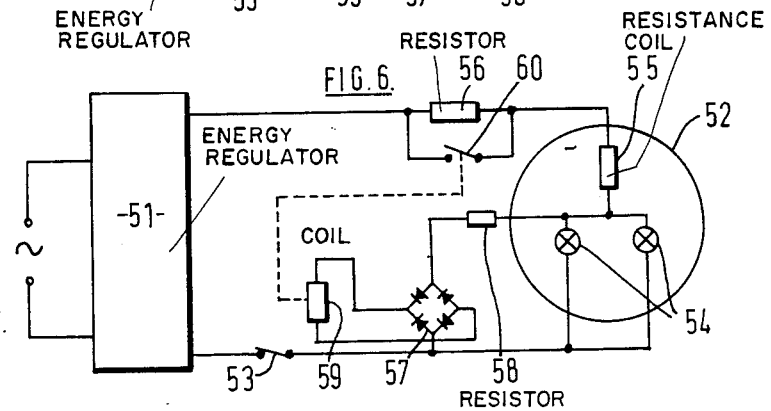
Figure 7:
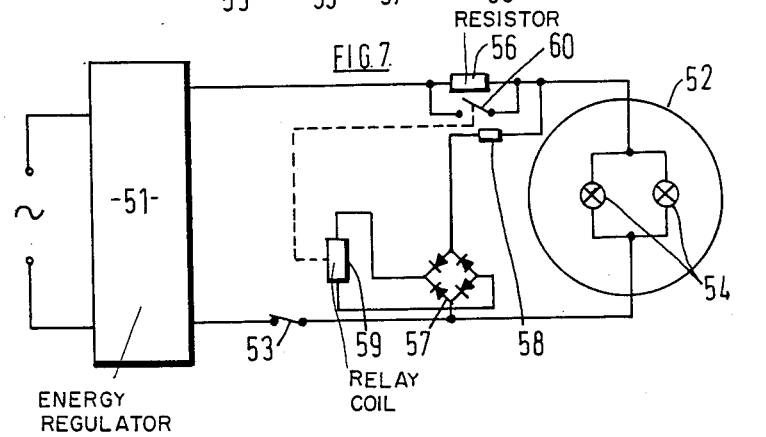

The circuit diagrams of FIGS. 5,6 and 7 show three practical embodiments of the present invention. Similar parts in FIGS. 5,6 and 7 are denoted by the same reference numerals.

FIG. 5 shows an energy regulator 51 which is electrically connected with heating elements in a heater dish 52 by way of a thermal cut-out device 53. In each embodiment the heating elements include two infra-red lamps 54, although in the embodiment of FIG. 5 two coils 55 of resistance wire are also provided and in the embodiment of FIG. 6 a single coil of resistance wire is provided.

In the embodiments of FIGS. 6 and 7 a resistive element 56 is provided externally of the heater dish 52.

The electrical voltage across the infra-red lamps 54 is passed to a rectifier 57 by way of a resistor 58. The rectified voltage is applied to the coil 59 of a relay which incorporates a switch 60.

In the embodiment of FIG. 5, applying voltage to the relay coil 59 causes the relay switch 60 to close. This results in the coils 55 being connected in parallel and thus reduces the combined resistance of the coils 55 and the infra-red lamps 54.

In the embodiments of FIGS. 6 and 7, applying voltage to the relay coil 59 causes the relay switch 60 to close and thus to short-circuit the external resistive element 56. This also reduces the combined resistance of the resistive element 56, the coil 55 (in FIG. 6) and the infra-red lamps 54. Because electric current passes through the resistive element 56 for only a short time, the average power consumed by the resistive element 56 over a substantial period is small and thus the resistive element does not generate a significant amount of heat externally of the body of the heater and can be a relatively low-rated component.

Although the typical operating time of a small relay is of the order of 10 to 20 milliseconds and thus too short in itself, we have found that when the energy regulator 51 becomes conductive the voltage across infra-red lamps 54 does not rise immediately to its equilibrium value. Arranging the actuating coil 59 of the relay across the infra-red lamps thus incorporates the delay due to the voltage rise into the overall delay thus bringing the overall delay to at least 30 milliseconds.

Figure 8:
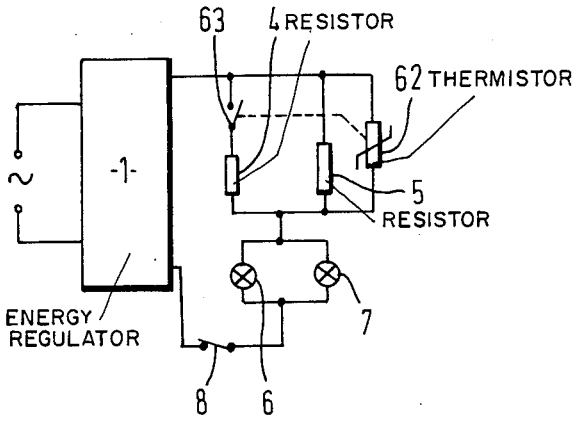
FIG. 8 is a diagrammatic illustration of an embodiment of a circuit diagram for a radiation heater according to the present invention and incorporating a PTC thermistor.

As as alternative to the use of a relay, the embodiment shown in FIG. 8 employs a switch means which comprises a PTC thermistor 62 and a snap-switch 63, although electronic delay means (for example based on a capacitor-resistor circuit) and/or electronic switching (for example based on triacs) may also be used. The thermistor 62 is connected across resistor 5 which effectively reduces the operating voltage when the snap-switch 63 is closed and thus increases the reliability of the thermistor. It is also possible to employ two PTC thermistors in combination with a relay.

With reference to FIGS. 1,2 and 4 to 8, a suitable NTC thermistor would permit the functions of the relay/snap-switch and the delay means to be combined.

The switch means may be an integral part of a terminal block which supplies electric current to the heating elements within the heater or may be mounted within the cooker hob or its control unit as a separate assembly.

Although the present invention has been described in conjunction with an energy regulator, it is possible to use a multi-position switch by means of which the heating elements are energised in a number of different configurations.

I claim:

1. An electric radiation heater assembly comprising:

at least one heating element having a substantial positive temperature coefficient of resistance;

a resistive assembly electrically connected in series with said at least one heating element for suppressing surge of electric current due to said at least one heating element, said resistive assembly comprising two resistive elements electrically connected in parallel;

means for supplying electric power to said at least one heating element and to said resistive assembly; and switch means operable a time interval of at least thirty milliseconds after a supply of electric power to said at least one heating element and to said resistive assembly is energised such that one of said resistive elements is electrically open-circuit until said time interval has expired and is thereafter electrically connected in parallel with the other of said resistive elements so as to reduce the combined electrical resistance of said at least one heating element and of said resistive assembly.

2. A heater assembly according to claim 1, wherein said at least one heating element comprises two heating elements.

3. A heater assembly according to claim 1, wherein said at least one heating element comprises an infra-red lamp.

4. A heater assembly according to claim 1, wherein the switch means comprises a relay including an actuating coil which is connected across said at least one heating element.

5. A heater assembly according to claim 1, wherein the switch means comprises a PTC thermistor in combination with a bi-metallic snap switch.

6. A heater assembly according to claim 1, wherein the time interval is from thirty milliseconds to 10 seconds.

7. A heater assembly according to claim 6, wherein the time interval is about ½ second.

8. An electric radiation heater assembly comprising:

at least one heating element having a substantial positive temperature coefficient of resistance;

a resistive assembly electrically connected in series with said at least one heating element for suppressing surge of electric current due to said at least one heating element;

means for supplying electric power to said at least one heating element and to said resistive assembly; and switch means operable a time interval of at least thirty milliseconds after a supply of electric power to said at least one heating element and to said resistive assembly is energised so as to reduce the combined electrical resistance of said at least one heating element and of said resistive assembly, said switch means comprising a relay including an actuating coil which is connected across said at least one heating element.

9. A heater assembly according to claim 8, wherein said at least one heating element comprises two heating elements.

10. A heater assembly according to claim 8, wherein said at least one heating element comprises an infra-red lamp.

11. A heater assembly according to claim 8, wherein the resistive assembly comprises a single resistive element positioned within a body of the heater, the resistive element being electrically short-circuited after said time interval.

12. A heater assembly according to claim 8, wherein the resistive assembly comprises a single resistive element positioned externally of a body of the heater, the resistive element being electrically short-circuited after said time interval.

13. A heater assembly according to claim 8, wherein the resistive assembly comprises two resistive elements electrically connected in parallel, one of said resistive elements being electrically open-circuit until said time interval has expired.

14. A heater assembly according to claim 8, wherein the time interval is from thirty milliseconds to 10 seconds.

15. A heater assembly according to claim 14, wherein the time interval is about ½ second.

16. An electric radiation heater assembly comprising:

at least one heating element having a substantial positive temperature coefficient of resistance;

a resistive assembly electrically connected in series with said at least one heating element for suppressing surge of electric current due to said at least one heating element;

means for supplying electric power to said at least one heating element and to said resistive assembly; and switch means operable a time interval of at least thirty milliseconds after a supply of electric power to said at least one heating element and said resistive assembly is energised so as to reduce the combined electrical resistance of said at least one heating element and of said resistive assembly, said switch means comprising a PTC thermistor in combination with a bi-metallic snap switch.

17. A heat assembly according to claim 16, wherein said at least one heating heating element comprises two heating elements.

18. A heater assembly according to claim 16, wherein said at least one heating element comprises an infra-red lamp.

19. A heater assembly according to claim 16, wherein the resistive assembly comprises two resistive elements electrically connected in parallel, one of said resistive elements being electrically open-circuit until said time interval has expired.

20. A heater assembly according to claim 16, wherein the time interval is from thirty milliseconds to 10 seconds.

21. A heater assembly according to claim 20, wherein the time interval is about ½ second.

* * * * *